United States Patent [19]

Man

[11] Patent Number: 4,889,040

[45] Date of Patent: Dec. 26, 1989

[54] INSULATED AND NON-METALLIC TRANSPARENT AND FULLY SEALED LOUVER SYSTEM

[75] Inventor: Henry H. Man, Salt Lake City, Utah

[73] Assignee: Continental Engineering Co., Inc., Salt Lake City, Utah

[21] Appl. No.: 277,888

[22] Filed: Nov. 30, 1988

[51] Int. Cl.[4] ..... E05B 65/04

[52] U.S. Cl. ..... 98/121.2; 49/88; 49/91; 49/92

[58] Field of Search ..... 49/88, 91, 92; 98/88.1, 98/100.5, 121.2; 137/601

[56] References Cited

U.S. PATENT DOCUMENTS 1,695,768 12/1928 Kelly ..... 49/88
3,110,936 11/1963 Berard ..... 49/92
4,057,936 11/1977 Wyatt, Jr. et al. ..... 49/91
4,497,134 2/1985 Meyer et al. ..... 49/91

FOREIGN PATENT DOCUMENTS 339593 12/1930 United Kingdom ..... 49/88

*Primary Examiner*—Harold Joyce
*Attorney, Agent, or Firm*—K. S. Cornaby

[57] ABSTRACT

A new non-metallic louver system made of substantially transparent polycarbon resin material by extrusion processing, which allows light through the closed louver blades when in the closed position, while producing an airtight and watertight system. The polycarbon resin composition of the louver system allows the unit to be lightweight, yet sturdy enough to withstand extremes of weather, fire and chemical corrosion.

6 Claims, 11 Drawing Sheets

INSULATED AND NON-METALLIC TRANSPARENT AND FULLY SEALED LOUVER SYSTEM

BACKGROUND OF THE INVENTION

This invention relates to the field of louvers used in buildings and houses to allow in varying degrees of sight, light and ventilation from the outside of the building. Louvers and louver systems have been disclosed in the art, but have comprised systems fully or substantially made of metallic parts. As a result, prior art louver systems have been heavy and cumbersome to install and operate. More importantly, they have provided little or no insulation from outside weather conditions or temperatures. No prior art louver system has been designed or constructed to meet Universal Building Codes with respect to wind loads, and they have not been particularly resistant to fire hazards and chemical degradation. These features are especially important when the louvers are being installed in industrial buildings where chemical resistance is require or highly desirable.

Because prior art louver systems have failed to meet specific needs dictated by certain weather and/or building conditions, the present invention has sought to remedy these deficiencies. In addition, the invention herein provides a new system by which light may be transmitted to the inside from the outside because of the transparent or translucent properties of the louvers.

SUMMARY OF THE INVENTION

The invention herein provides a new louver blade and louver system which meets the criteria found lacking in prior art louver systems. The louver blades and frame system are made of an extruded polycarbonate, PVC, or fiberglass resin material which makes the louvers and louver frame very lightweight, yet sturdy. These resin materials are ninety percent transparent and allow the louver blades to let in light when they are in the closed position, and enhance light transmission in the open position. Colorants may be added to the resin material used to manufacture the frame for decorating or design tastes. Because the entire louver system is made of polycarbonate, PVC, or fiberglass resin material, it is completely waterproof, and as designed, is airtight. Further, the resin materials are resistant to chemical corrosion and destruction by fire.

Although these resin materials result in a lightweight system, when incorporated into the design of this louver system, the louver blades are capable of withstanding hurricane strength winds in excess of 100 m.p.h. The louver system is extremely sturdy, but reinforcement can be added to the hollow blades making them virtually unbreakable and impregnable to burglary attempts.

The design incorporates an elastomer seal strip spanning the length of each blade. When in the closed position, the blades interface to produce an airtight, watertight and insulated barrier to the outside. The manner of extrusion of the component parts provides for uncomplicated manufacture and assembly. The louver frame is easily assembled with airtight and watertight resin glue, welded together in a heating procedure.

It is an objective of this invention to provide a new louver blade and frame system which is optimal for industrial use as well as residential use, which is completely airtight and watertight while being transparent and insulated.

It is further an objective of this invention to provide a louver blade and frame system which, by virtue of its manufacture, is strong but lightweight.

It is yet another objective of this invention to provide a louver blade and frame system which is resistant to chemical corrosion and extremes of weather conditions, and is resistant to fire hazards.

These and further advantages will be made more apparent in the discussion which follows.

THE DRAWINGS

DETAILED DESCRIPTION OF THE PREFERRED EMBODIMENT

Figure 1:
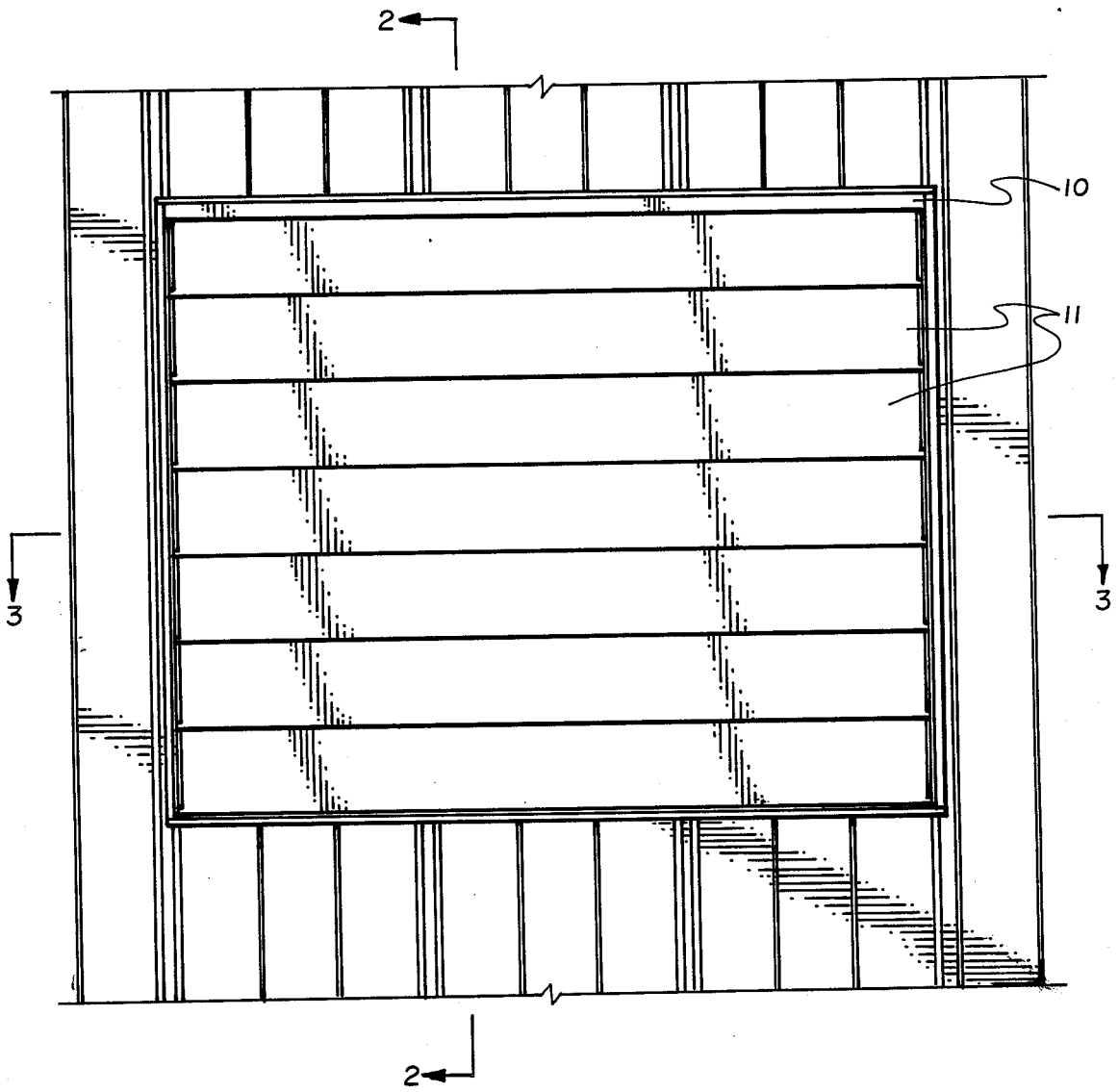
FIG. 1 is a plan view of the louver system installed in the wall of a building illustrating placement therein.

The assembled louver system is installed, with louver blades, in a preformed opening in the wall of the building. FIG. 1 illustrates the placement of the louver system 10 in the wall. The horizontal blades 11 are shown in the closed position.

Figure 2:
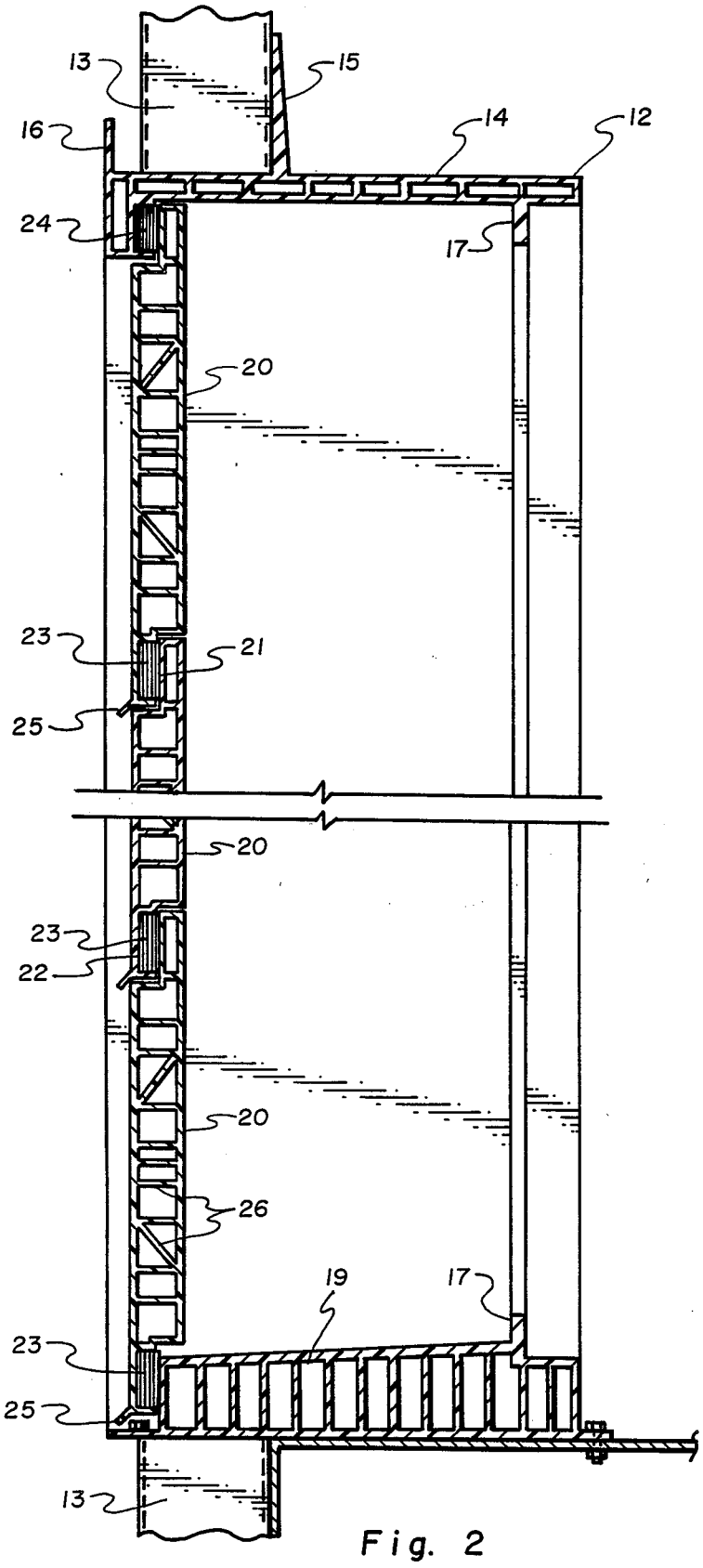
FIG. 2 is a cross-sectional view in a vertical plane taken through line 2—2 of FIG. 1.

In FIG. 2, the louver frame, generally at 12, is shown installed within the wall opening 13. The frame is comprised of four modular units: the header 14, the sill 19, and two sides or jambs 27, shown in FIG. 2. The header unit 14 is extended with a positioning leg 15 for attachment of the frame to the building with bolts, and the leg 15 also serves to keep out rain. A louver system not used in a steel building would not have the leg 15. The header unit is also extended with an upwardly extended shield 16, and a screen flange 17. The upwardly extended shield 16 of the header draws water away from the blades. The sill 19 is also molded with a screen flange 17. The lower sill is manufactured with an inner sloping face to promote drainage of any accumulated moisture. All four modular units, including the two side units or jambs of the frame, are extruded in such a way as to be hollow. Air trapped in the hollow spaces of the modular units serves as insulation. The louver blades 20 are shown in the closed position. Each blade has an upper recess 21 and a lower recess 22 which allows the upper and lower edge of each blade to nest in the adjacent blade's interfacing recess. In the lower recess 22 of each blade there is an elastomer seal 23 running the length of the lower blade recess. The upper recess 21 of the lower blade seals tightly thereagainst, when in the closed position, to form an airtight and watertight seal. The uppermost blade in the system interfaces with an elastomer seal 24 which runs the inner length of the front portion of the header 16. The elastomer seal in the lower recess of the lowermost blade interfaces with the front face of the sill 19 of the frame to form an airtight and watertight seal. Each blade has at its lower edge, and formed in an outward orientation, a drip-lip 25 to propel water away from the outer face of the blade. As further illustrated in FIG. 2, each blade is hollow as a result of the extrusion process which also allows for insulation provided by trapped air within. Horizontal and diagonal ribs 26 spanning the gap between the hollowed space provide strength to the blades. Where required by extremes of weather or other conditions, the hollow spaces within the blades can be filled by an appropriate reinforcement material to add structural strength to the blade. In manufacturing, the blades are extended in oversized lengths making custom sizing readily available. The blades may also be used in conventional steel louver frame structures.

Figure 3:
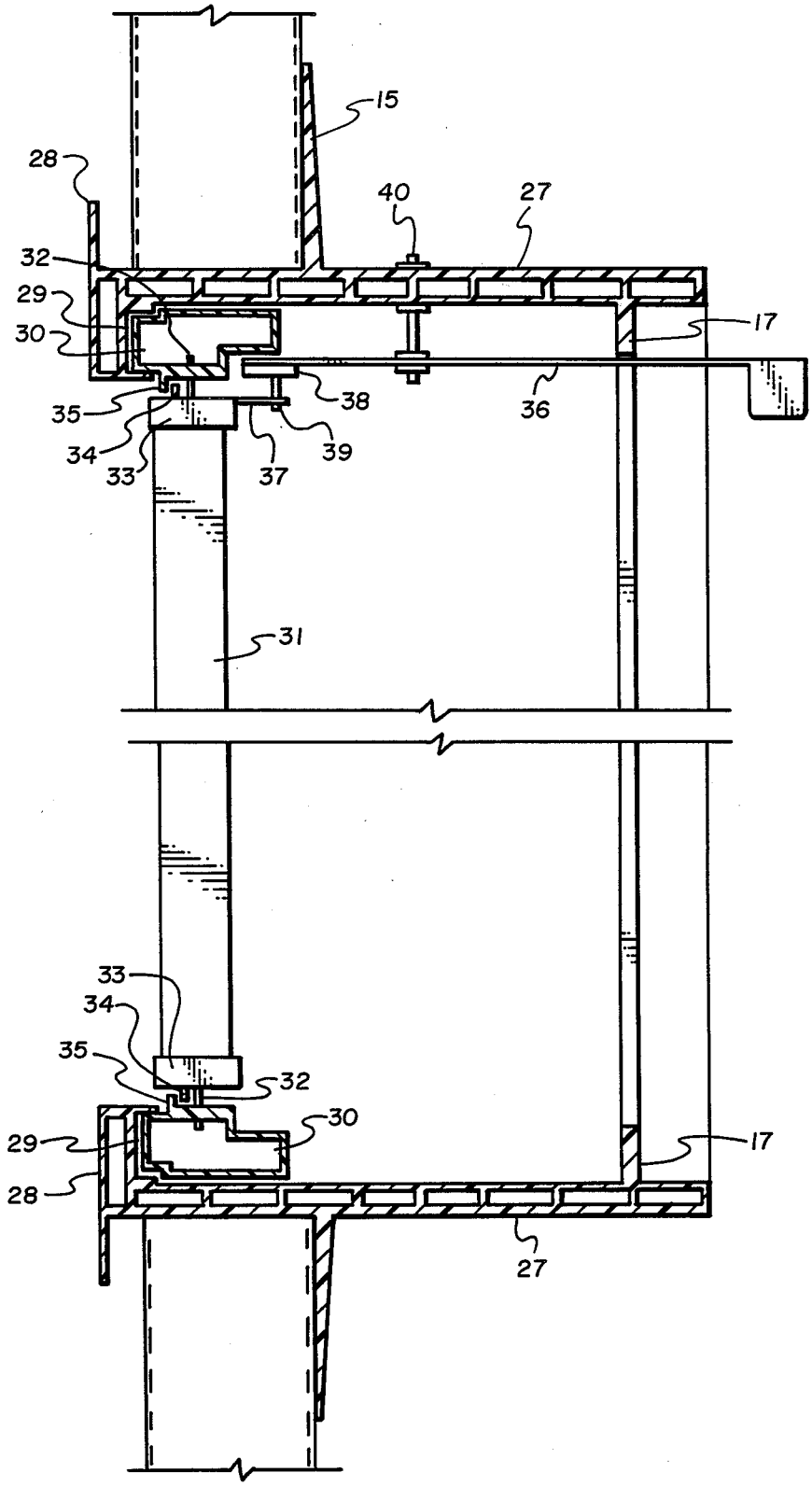
FIG. 3 is a cross-sectional view taken through line 3—3 of FIG. 1.

The jambs 27 of the frame are illustrated in FIG. 3, and each is extruded with the positioning bracket 15, a shield 28, an inner recess 29 for placement of the supporting channel, and screen flange 17. The jambs are also hollow as a result of the extrusion process in manufacture. Nested within the recess 29 is a hollow supporting channel 30. Each blade 31 is held in place between the supporting channels 30 by means of a rotating pin 32 molded in and extending outwardly from the blade cap 33 at either end of each blade. A positioning pin 34 also molded in the end caps 33 of the blades maintain the blades in a maximum horizontal position when in the open position This is accomplished by the positioning pin 34 striking an outwardly projected flange 35 of the forward edge of each supporting channel 30. Movement of the blades is accomplished by upward and downward motion of a lever 36 about a pivot pin 40 which is anchored through the jamb. The inward end of the lever is connected to a vertical bar 38 which spans the inner length of the frame. Each end cap on the end of the blade closest to the lever is molded with a connector arm 37 through which a swivel pin 39 projects. The distal end of the swivel pin is connected to the vertical bar 37.

Figure 4:
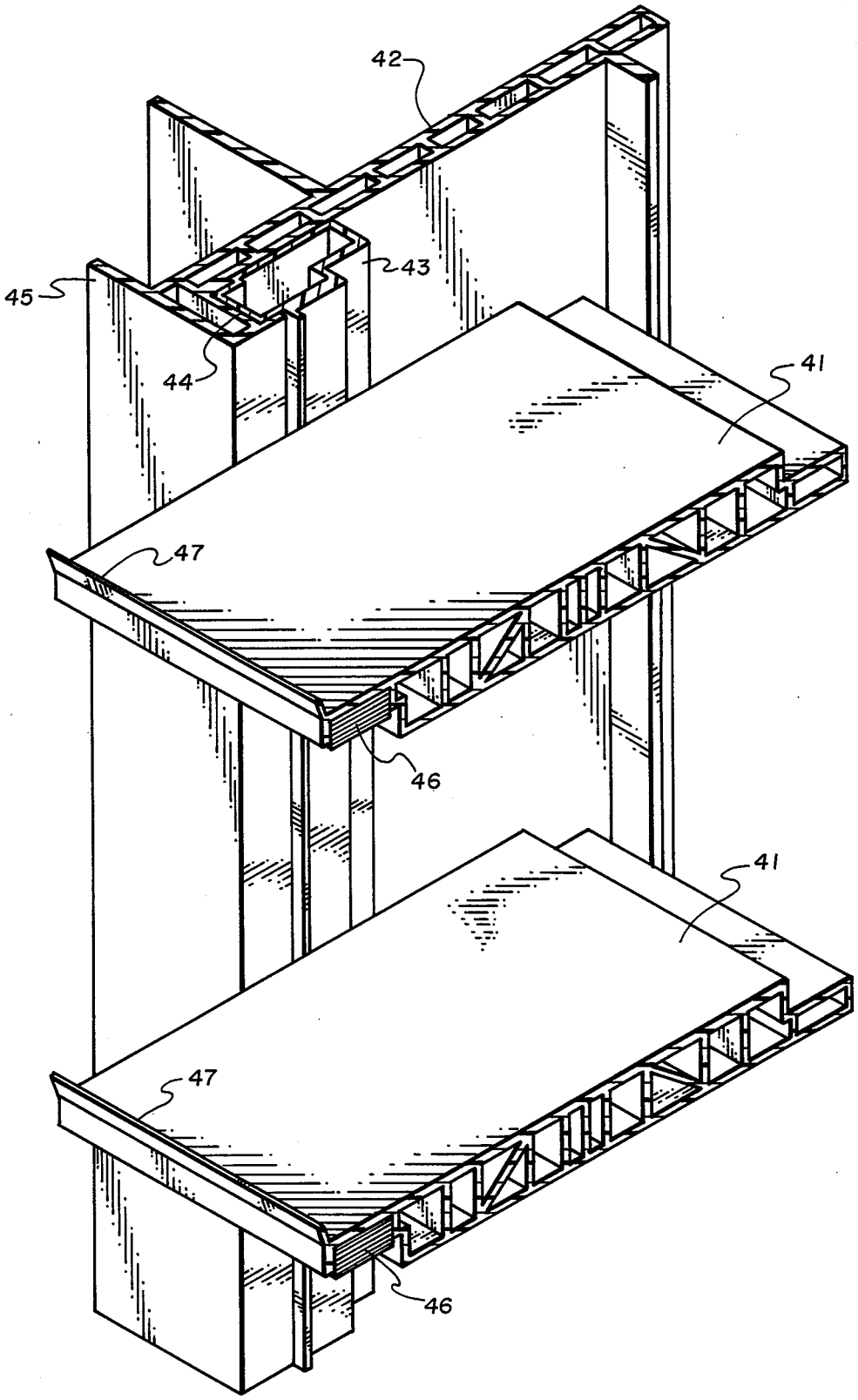
FIG. 4 is a perspective view of the louver blade and frame system where the blades and frame are in partial cross-section.

FIG. 4 demonstrates the position of the blades 41 in orientation to the jamb 42. The supporting channel 43 about which the blades swivel is illustrated nested into the recess 44. In cross-section, the elastomer seal 46 is shown to run the length of the lower recess of the blade, and the drip-lip 47 is shown extending outwardly from the lower edge of the blade.

Figure 5:
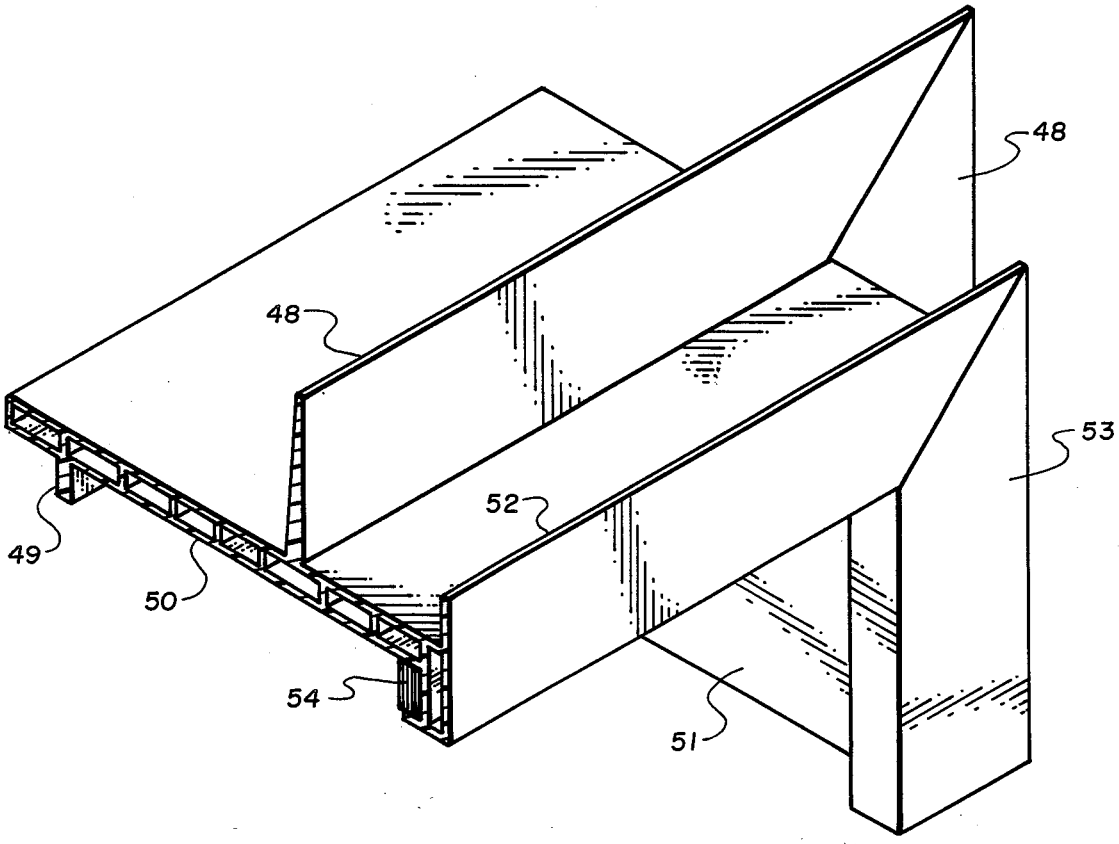
FIG. 5 is a perspective view in partial cross-section of headers and one corner of the louver frame.

FIG. 5 illustrates the conformation of the frame modules when connected together. The molded positioning legs 48 of the header 50 and jambs 51 are shown to meet in a mitered fashion. The shield 52 of the header is shown meeting the shield 53 of the jamb in the mitered corner. The modular units, and all other independent parts, are joined together with resin glue under heat application. The elastomer seal 54 housed within the recess of the shield 52 is shown. The screen flange 49 is also illustrated.

Figure 6:
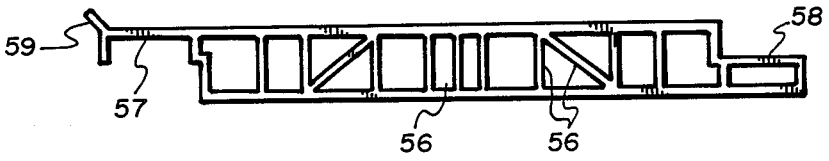
FIG. 6 is a cross-sectional view of a single blade.
Figure 6A:
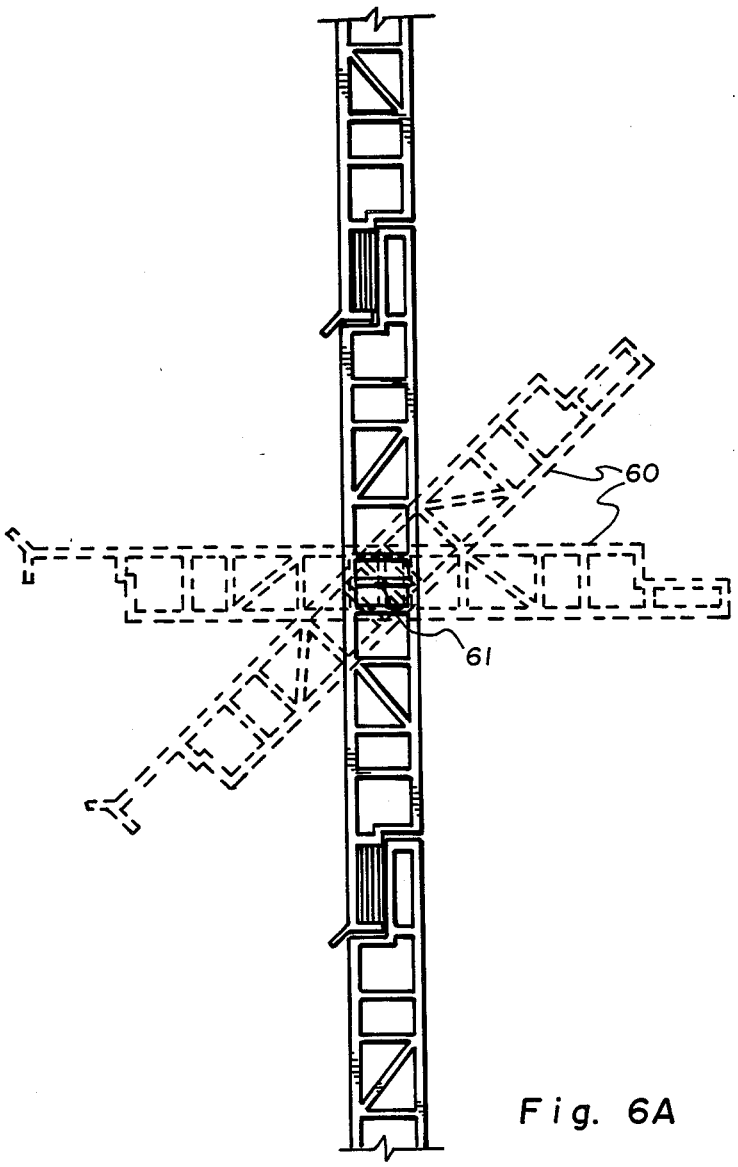
FIG. 6A is a cross-sectional view of a blade illustrating its position with respect to other blades.

FIG. 6 is illustrated the blade 55 in cross-section, and further illustrates the horizontal and diagonal ribs 56 which span the hollowed gap. Shown is the lower recess 57 wherein lies the elastomer seal (not shown), and the upper recesses 58 which interfaces with the lower recess of the blade above (not shown). The drip-lip 59 at the lower edge of the blade can be seen. Notably, the blade is flat on its inner and outer surface. This makes the blade face resistant to collection of dust. FIG. 6A demonstrates the movement of the blade 60 about the rotation pin 61, and indicates the range of movements possible.

Figure 7C:
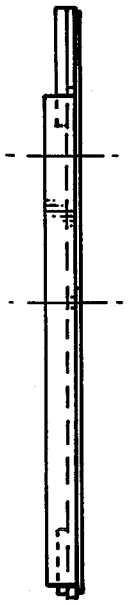
FIG. 7C is a plan view of still another embodiment of the end caps of the blades.
Figure 7D:
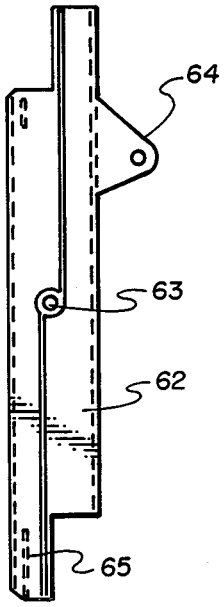
FIG. 7D is a plan view of still a further embodiment of the end caps of the blades.
Figure 7E:
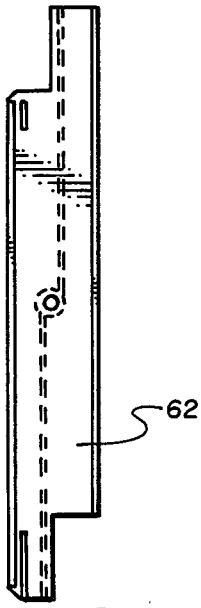
FIG. 7E is a plan view of an alternative embodiment of the end caps of the blades.
Figure 7:
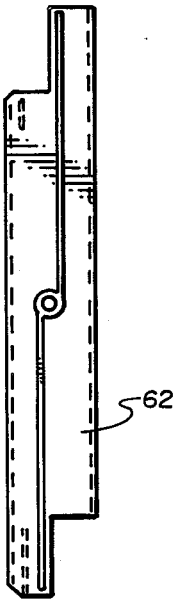
FIG. 7 is a plan view of an embodiment of the end caps of the blades.
Figure 7A:
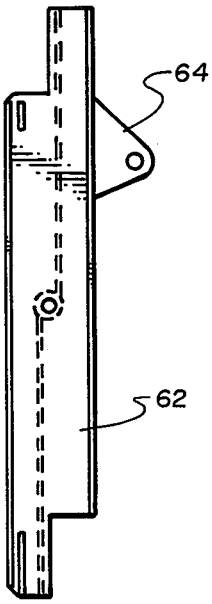
FIG. 7A is a plan view of another embodiment of the end caps of the blades.
Figure 7B:
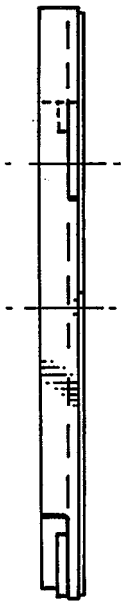
FIG. 7B is a plan view of a further embodiment of the end caps of the blades.

FIG. 7 illustrates the conformation of the end cap 62 from which extends the rotation pin 63, the connecting arm 64, and the positioning pin 65.

Figure 8:
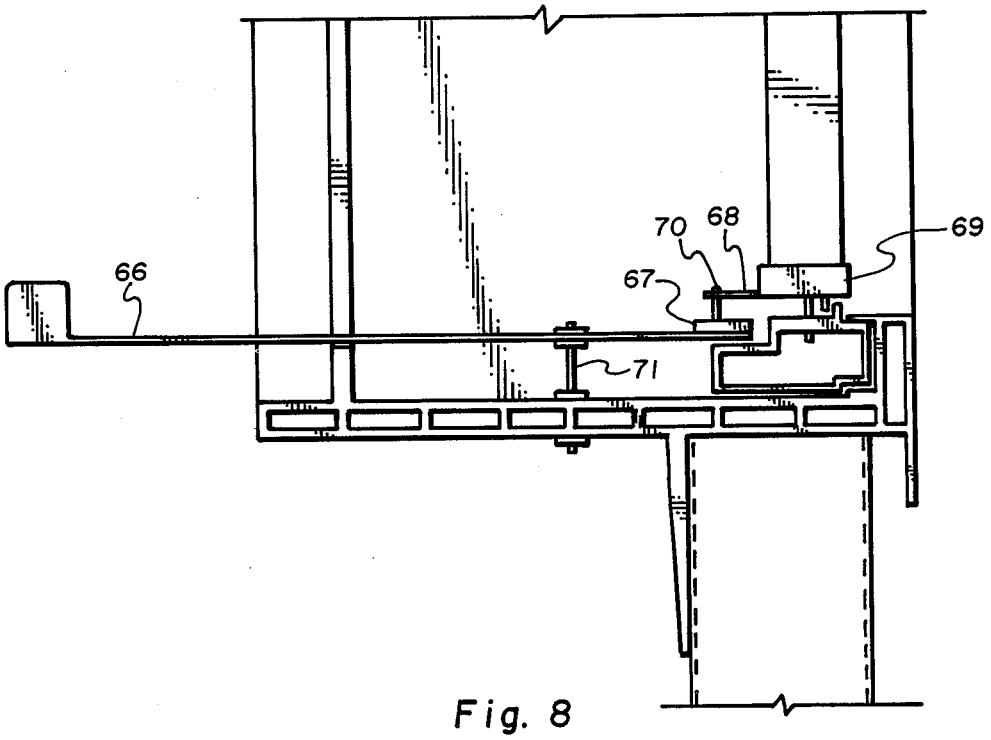
FIG. 8 is an enlarged plan view in partial cross-section of the operating mechanism.
Figure 9:
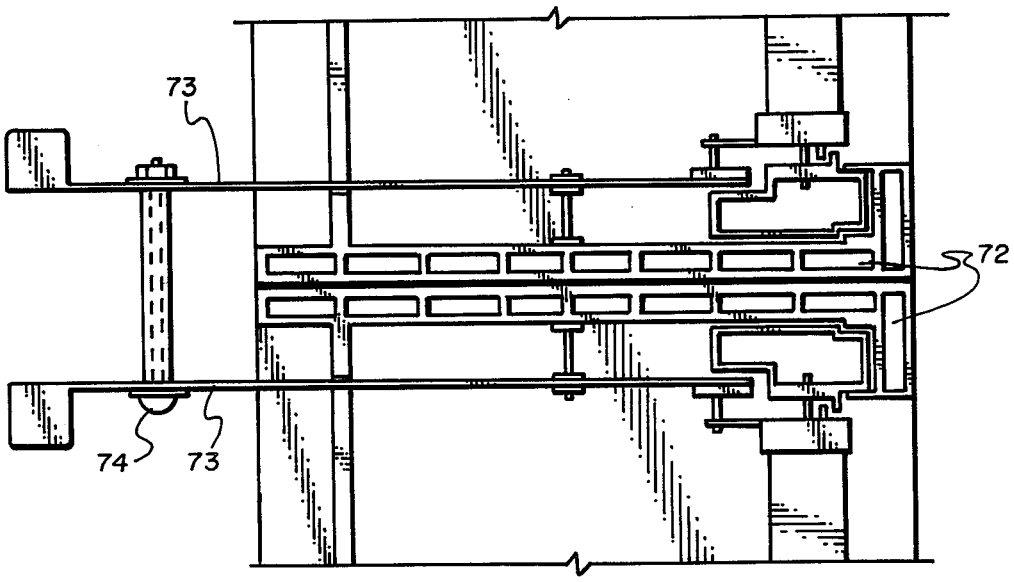
FIG. 9 is an enlarged plan view in partial cross-section of a dual operating mechanism embodiment.

FIG. 8 is an enlargement of the operating mechanism of the preferred embodiment. Illustrated therein are the lever 66 connected at its inward end to the vertical bar 67 which is in turn connected to the connecting arm 68 of each end cap 69 by means of the swivel pin 70. The lever is shown to rotate around the pivot pin 71. The operating mechanism can be placed on either the right jamb or left jamb. This varied placement allows a dual operating mechanism when two louver frames are positioned side by side. FIG. 9 demonstrates an alternative embodiment of the operating mechanism which would be utilized in a double louver system where the vertical frames 72 of two louver systems are side by side. The two levers 73 are connected to each other by a connecting bolt 75 therebetween.

Figure 10:
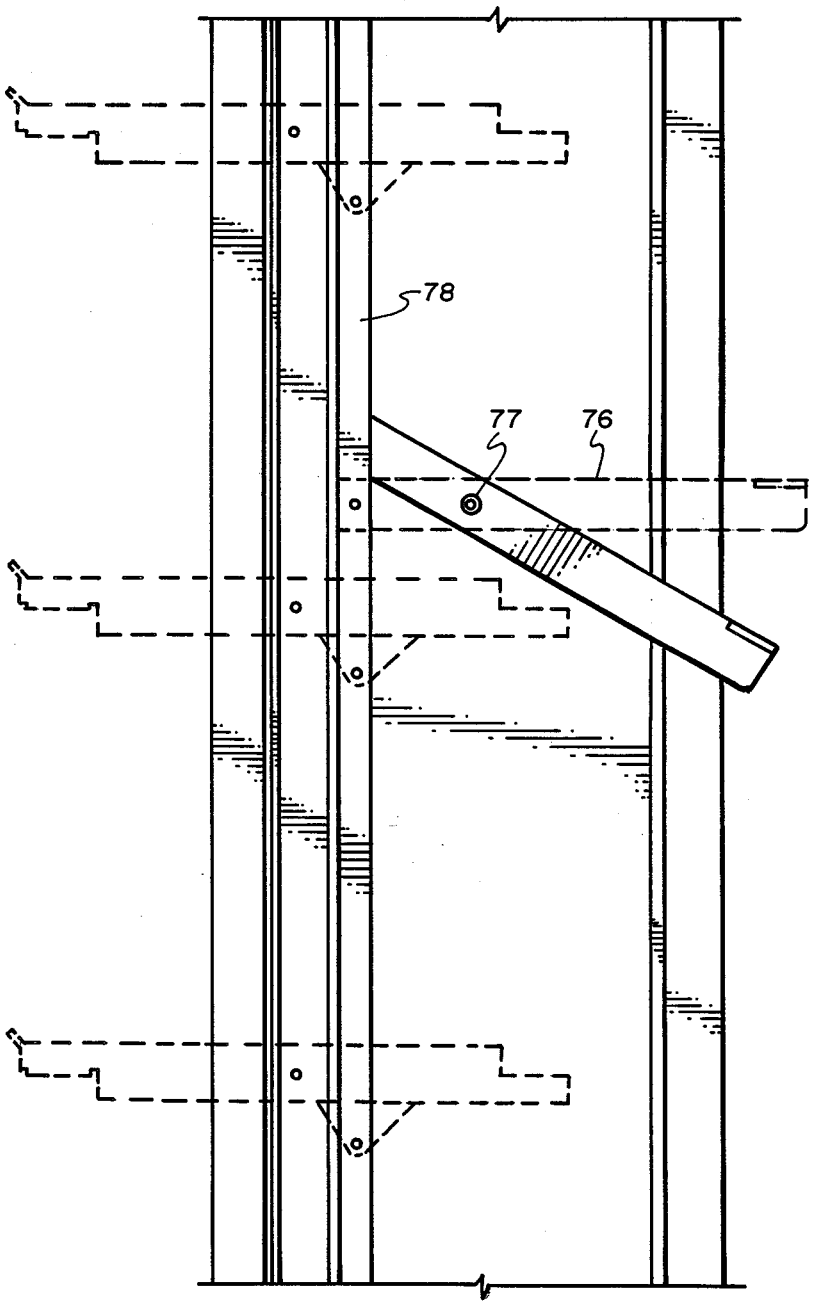
FIG. 10 is a plan view of the inner surface of the vertical side member of the frame where the operating mechanism is attached, blade members being illustrated in phantom.
Figure 11:
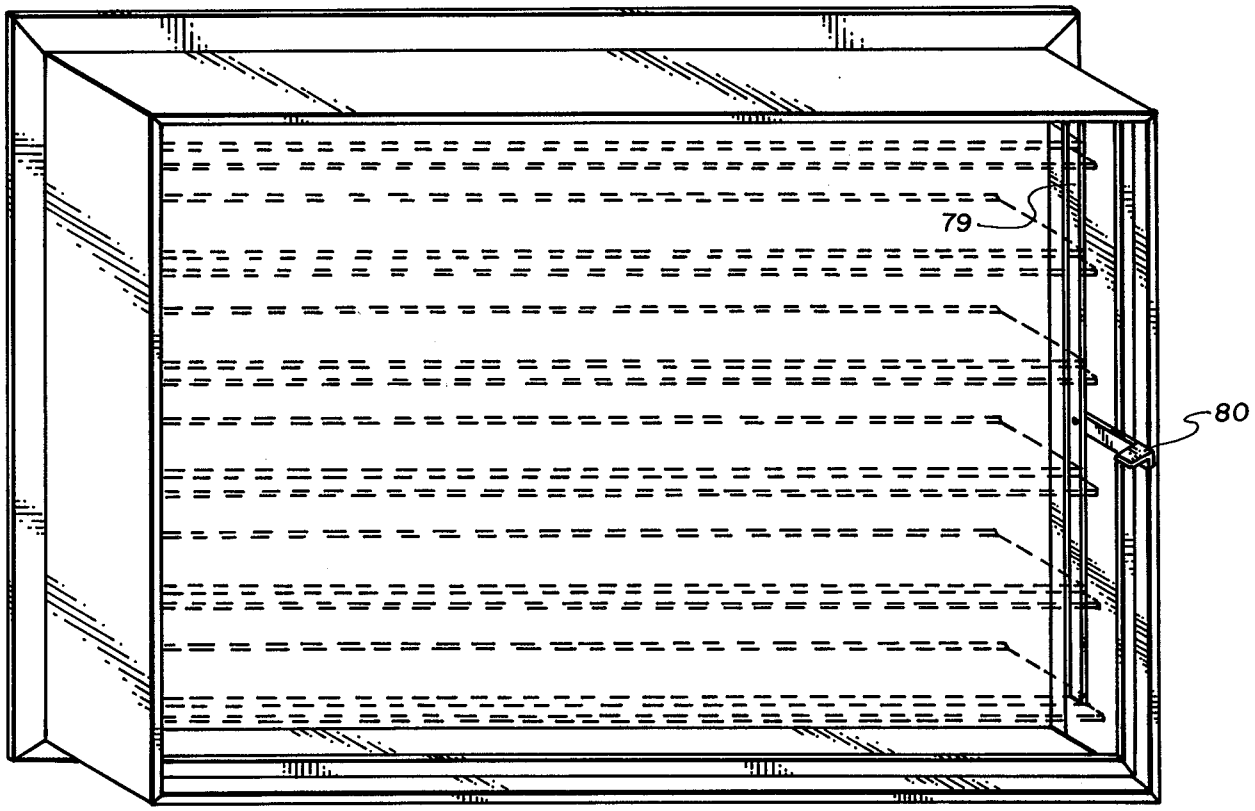
FIG. 11 is a perspective view of the invention shown from inside the building.

FIG. 10 demonstrates the operation of the lever 76 when rotated upwardly about the rotating pin 77 to move the vertical bar 78 down to engage the blades (shown in dotted line) to the open or horizontal position. A view of the louver system from inside the building is shown in FIG. 11 in which the louver blades are in the open position. FIG. 11 further shows the orientation of the vertical bar 79 to the lever 80.

Figure 12A:
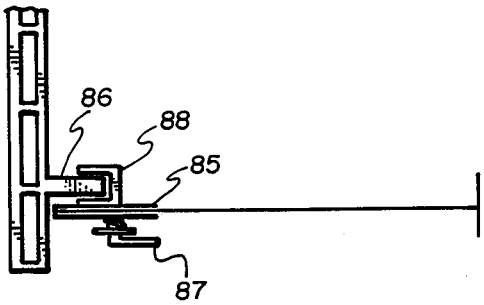
FIG. 12A is an enlarged cross-sectional view of the screen attached to the louver frame.
Figure 12:
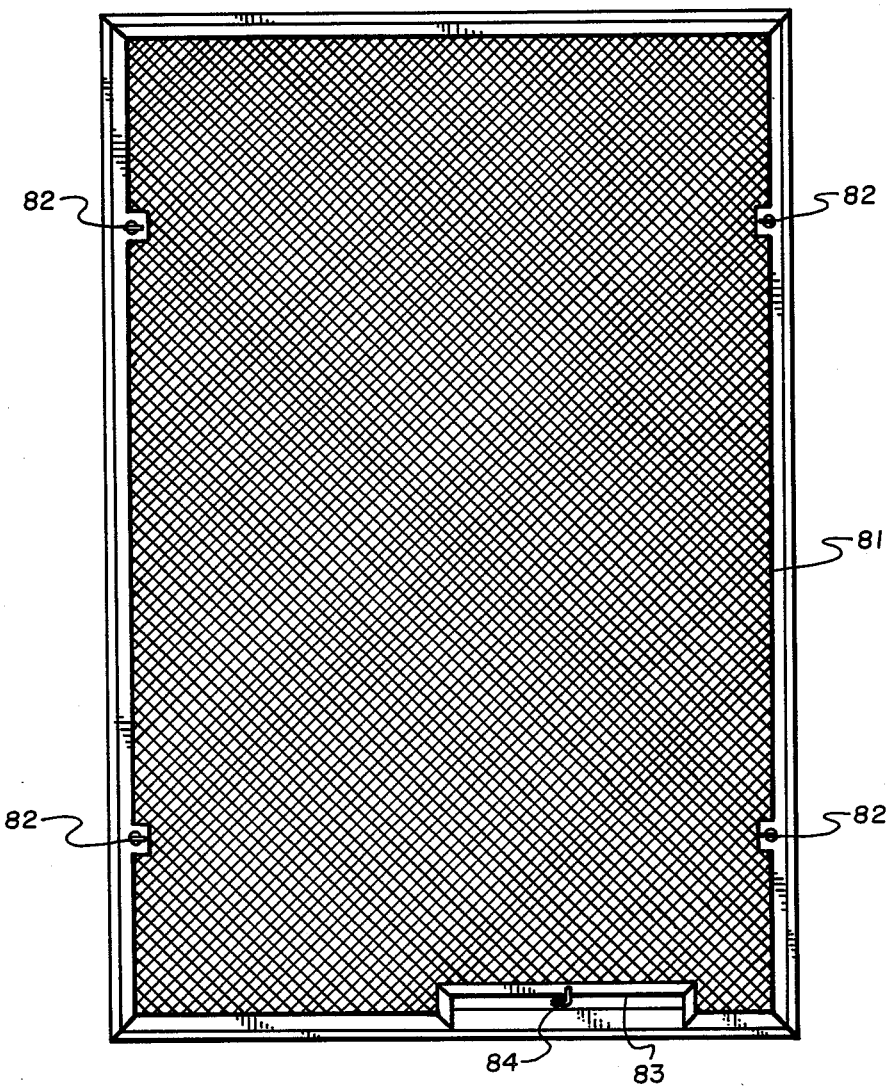
FIG. 12 is a plan view of the screen.

The screen 81 which covers the portion of the frame inside the building is shown in FIG. 12. The screen is connected to the screen flange by at least four rotating bracket fasteners 82. One side of the screen is fashioned with a cut out portion 83 which allows for movement of the lever 84 when opening and closing the louver blades.

The means for fastening the screen frame 85 to the screen flange 86 is illustrated in FIG. 12A. When set in place against the flange, the screen fasteners 87 are rotated so as to simultaneously rotate a U-bracket 88 on the inner side of the screen frame which engages with the screen flange 86. This mechanism allows for each removal of the screen for cleaning.

I claim:

1. A louver system for industrial and residential use comprising, in combination:

a frame means for housing multiple louver blades in parallel conformation to each other, said frame being made of material having transparent qualities;

said multiple louver blades each being formed as a single unit comprising a front face and back face, substantially hollowed therebetween with structural ribs spanning the hollowed space, said louver blades being made of material having transparent airtight and insulation qualities; and an operating mechanism means for opening and closing said louver blades which is made of material having transparent qualities.

2. A louver system as set forth in claim 1 in which said front face of said blade has formed at its lower edge facing inwardly in orientation to the blade, a recess in which a seal strip is placed, said seal strip being made of an elastomer material, and said front face of said blade having formed at its lower edge facing outwardly in orientation to the blade, a curved lip, and said back face of said blade having formed at its upper edge facing outwardly in orientation to said blade a recess.

3. A louver system as set forth in claim 2 in which each said blade has at either end a molded end cap made of material having transparent qualities.

4. A louver system as set forth in claim 1 which further comprises a removable screen attached to said frame means in an orientation opposite to the housing of said multiple louver blades.

5. A louver system as set forth in claim 1 in which said operating mechanism means further comprises a movable lever with front end and back end, rotatable about a rotation pin, said back end being connected to a vertical bar, and said bar being integrally connected to each blade by means for connecting thereto.

6. A louver system as set forth in claim 1 in which the material having transparent qualities is a polycarbonate material, PVC material, or fiberglass resin material.

* * * * *